US005605731A

United States Patent [19]

Guasch Pubill

[11] Patent Number: 5,605,731

[45] Date of Patent: Feb. 25, 1997

[54] PROCESS FOR OBTAINING DISPOSABLE CLEANING CLOTHS AND RESULTING DISPOSABLE CLEANING CLOTH

[76] Inventor: Marcos Guasch Pubill, Pere IV, 314, Barcelona, Spain, E-08005

[21] Appl. No.: 196,758

[22] Filed: Feb. 15, 1994

[30] Foreign Application Priority Data

| | | | |
|---|---|---|---|
| Mar. 1, 1993 | [ES] | Spain | P 9300565 |
| Oct. 30, 1993 | [ES] | Spain | P 9302060 |
| Jan. 18, 1994 | [ES] | Spain | P 9400089 |

[51] Int. Cl.[6] ..... B65D 65/28

[52] U.S. Cl. ..... 428/43; 428/195; 83/43; 83/44; 83/45; 83/47; 264/146; 264/160

[58] Field of Search ..... 428/43, 195; 83/16, 83/42, 44, 45, 47, 43; 156/88, 250, 251, 252, 277; 264/146, 160

[56] References Cited

U.S. PATENT DOCUMENTS

| | | | |
|---|---|---|---|
| 4,888,229 | 12/1989 | Paley et al. | 428/192 |
| 5,069,735 | 12/1991 | Reynolds | 156/497 |
| 5,225,649 | 7/1993 | Andreoli et al. | 219/121.67 |

*Primary Examiner*—Christopher Raimund

*Attorney, Agent, or Firm*—Jacobson, Price, Holman & Stern, PLLC

[57] ABSTRACT

A process for obtaining disposable cleaning cloths is disclosed which consists in taking a fabric piece of a width corresponding to that of the cleaning cloth to be obtained and subjecting it to successive intermittent transversal cuts in the direction of the weft spaced according to the length of the cleaning cloth. The cuts prevent unravelling and help the user to detach each cleaning cloth individually from the rest of the piece. The cleaning cloths have longitudinal edges which may not be unravelled in the direction of the warp. If the piece of fabric is of a width which is a multiple of the envisaged width of the cleaning cloths, longitudinal cuts are made in the piece of fabric spaced apart from each other in the direction of the warp after which intermittent transversal cuts are made.

The resulting cleaning cloth consists of a rectangular portion of fabric whose four edges may not be unravelled.

9 Claims, 4 Drawing Sheets

PROCESS FOR OBTAINING DISPOSABLE CLEANING CLOTHS AND RESULTING DISPOSABLE CLEANING CLOTH

The invention relates to a process for obtaining disposable cleaning cloths and the resulting disposable cleaning cloth.

Until now, cleaning cloths have been used for household and industrial cleaning, at a relatively high cost, since they are generally obtained from pieces of fabric which on output from the loom are subjected to a number of conventional continuous or batch industrial finishing processes, which pieces are then subjected after cutting thereof to an operation of making-up the edges. The aforesaid making-up process notably increases the cost of the cleaning cloth, which means that it has to undergo frequent washing operations for subsequent re-use, whether it has been put to household or industrial uses, such as in factories and workshops, and others. The cleaning cloths generally known therefore present the disadvantages of their high price owing to the making-up process they require, and the fact that they call for very thorough cleaning if they are to be used again, owing to the grease and other major dirt impregnating them.

Also known are individual tear-off rolls or hand tissues and the like, of paper or non-woven fabric, made for certain uses, although they do not have the right consistency for certain jobs in the household and industrial (factories, workshops, etc.) settings, and although they are disposable, that is, they are single-use articles, they do not fulfil the expectations held of cleaning cloths, although they are of low cost.

According to FR-A-1 194 801, a cleaning cloth is obtained from a band made up of several cleaning cloths joined together by means of adhesive which permits subsequent individual detachment of said cleaning cloths, while according to FR-A-2 319 489 a two-sided cleaning cloth is obtained, one side being fibrous and the other impermeable, forming a roll with partial transversal cuts at intervals and with adhesive to sides, thus providing for subsequent individual detachment of the cleaning cloths.

The cleaning cloths referred to in these two patents do not have their four side edges ravel-free.

The present invention eliminates the aforesaid disadvantages of conventional made-up fabric cleaning cloths and of individual paper or fabric tear-off rolls or hand tissues and the like, since it has as its object a process for manufacturing disposable cleaning cloths and the resulting disposable cleaning cloth itself, and presents the advantages of consistency of made-up fabric cleaning cloths, providing same at a notably lower price, and the fact that they are single-use articles like tear-off paper rolls or hand tissues and the like, being of highly competitive unit price, incomparably cheaper than made-up fabric cloths and at a cost very close to that of paper tissues.

Similarly, the disposable cleaning cloth obtained by the process of the invention is especially applicable to cleaning tasks, but also for use as a serviette, table cloth, hand towel, washleathers, handkerchief, etc.

In essence, according to the process of the invention, the fabric piece is of a width corresponding to that of the cleaning cloth to be obtained, and it undergoes successive intermittent transversal cuts in the direction of the weft, spaced according to the length of the cleaning cloth, which cuts, as the edge threads are joined to each other, prevent unravelling and help the user to detach each cleaning cloth individually from the rest of the piece, the cleaning cloth having similarly unravel-proof longitudinal edges in the direction of the warp.

According to the invention, the piece of fabric may be of a width which is a multiple of the envisaged width of the cleaning cloths, longitudinal cuts being made in the piece of fabric in the direction of the warp, spaced according to the width of the cleaning cloths, after which intermittent transversal cuts are made in the direction of the weft. The said longitudinal and transversal cuts can be made in the piece of fabric in such a way that in the cutting operation itself the cut threads are bonded together, in order to avoid unravelling of the edges of the disposable cleaning cloth obtained, or else by carrying out two operations, of cutting and bonding of the cut threads, respectively, in order to avoid unravelling of the edges of the cleaning cloth, which operations can be carried out in any suitable order.

The disposable cleaning cloth obtained with the process of the invention consists in a rectangular portion of fabric whose four edges may not be unravelled.

Provision has also been made for obtaining a cleaning cloth with greater resistance to washing, with edges more resistant to unravelling, whose manufacturing operation includes printing of any suitable trademark and/or ornamentation.

To this end, the bonding of the threads in the cutting zones is implemented by printing, which process, in combination with utilization of a cleaning cloth of suitable thickness, permits a long-duration cleaning cloth to be obtained, whose edges do not unravel even after several washing operations.

Likewise, the print operation provides the cleaning cloth with a peripheral trim of a particular colour and printing of any trademark and ornamental or publicity motives desired.

It is likewise envisaged that the transversal cut of the fabric piece be continuous, in order to obtain loose cleaning cloths for commercialization thereof in various presentations and in particular in rolled form with one cleaning cloth placed over the next, the rear-edge zone of one cleaning cloth overlapping the front-edge zone of the following cleaning cloth.

In order to obtain a cleaning cloth of the same characteristics indicated, but a lower cost, the process provides for a single cutting operation by means of which the longitudinal and transversal cuts are made, while the latter can be continuous for provision of loose cleaning cloths or intermittent to provide rolls of cleaning cloths in succession which the user can easily detach individually.

Although in principle provision is made herein for carrying out this cutting operation simultaneously for the longitudinal and transversal cuts, by means of an operation independent of the adhesive bonding or printing operations performed on the cut zones, the possibility of simultaneous execution of the two operations of cutting and bonding of threads is not excluded.

These and other characteristics will better emerge from the detailed description which follows, in order to facilitate understanding of which four sheets of drawings are attached, showing non-limitative embodiments of the scope of the invention.

Figure 2:
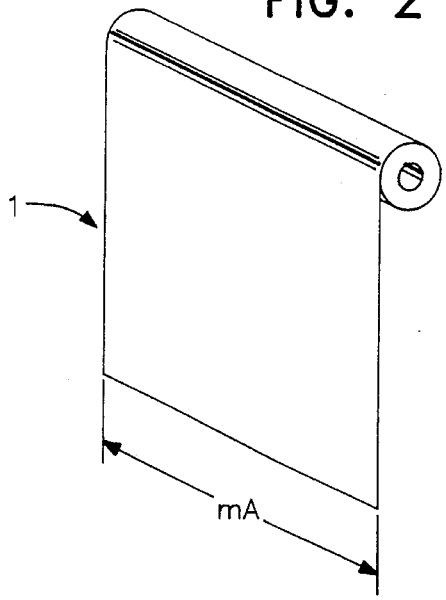
FIG. 2 is a perspective view of the piece of rolled fabric of a width which is a multiple of that of the cleaning cloth to be obtained.
Figure 2A:
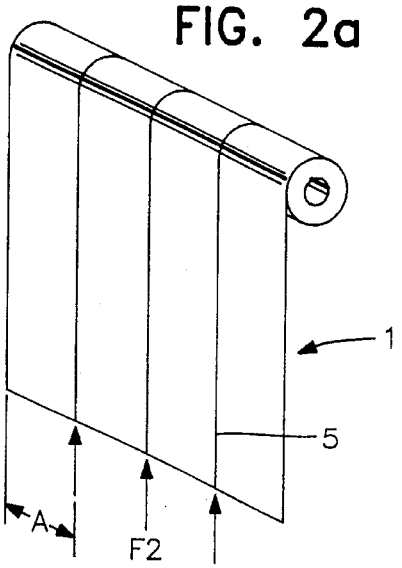
Figure 2B:
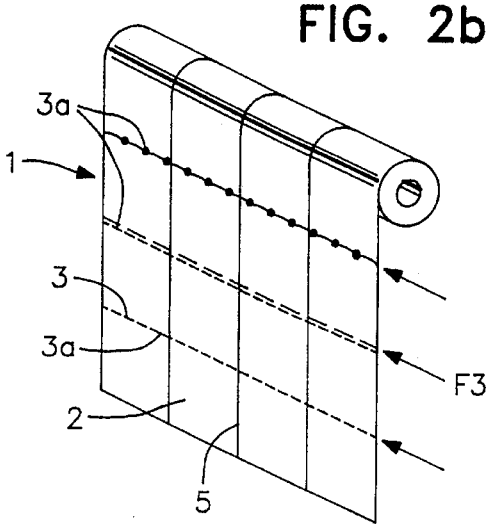
Figure 3A:
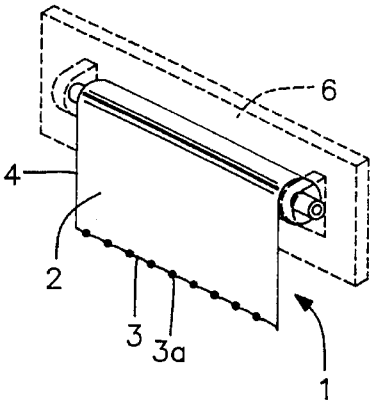
Figure 3B:
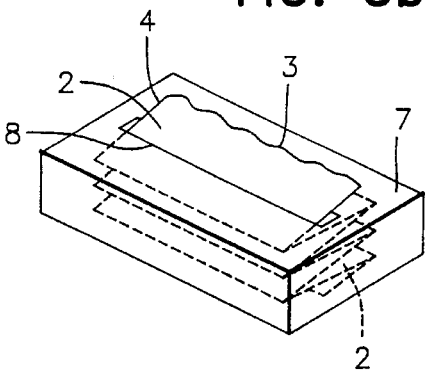
Figure 4:
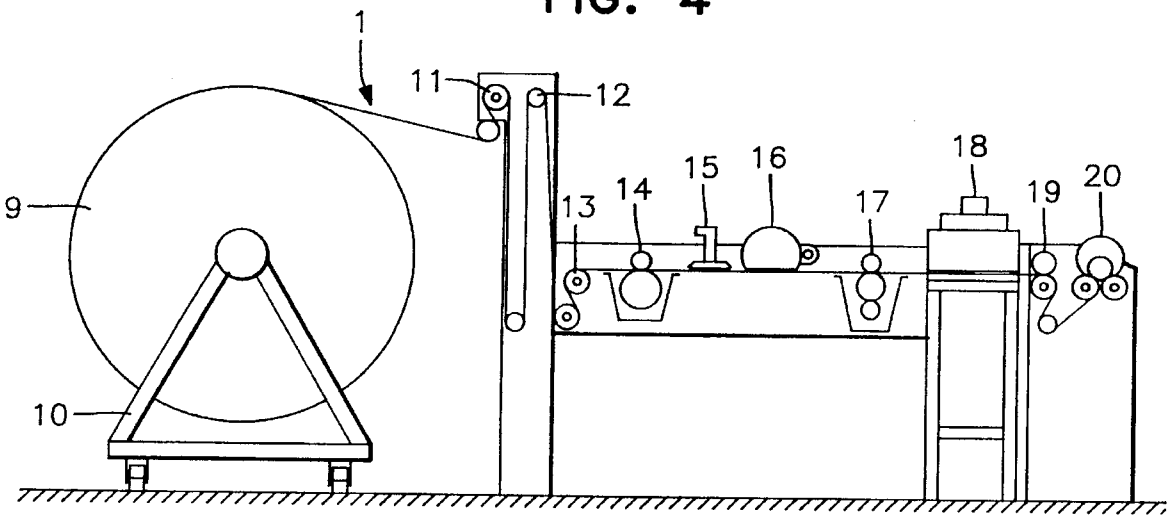
Figure 5:
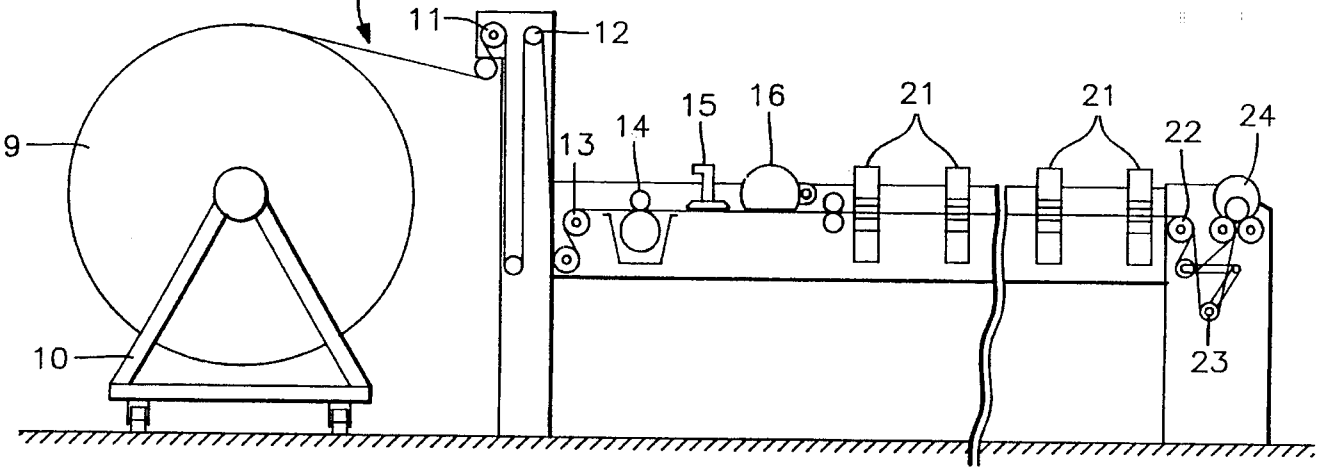
Figure 6:
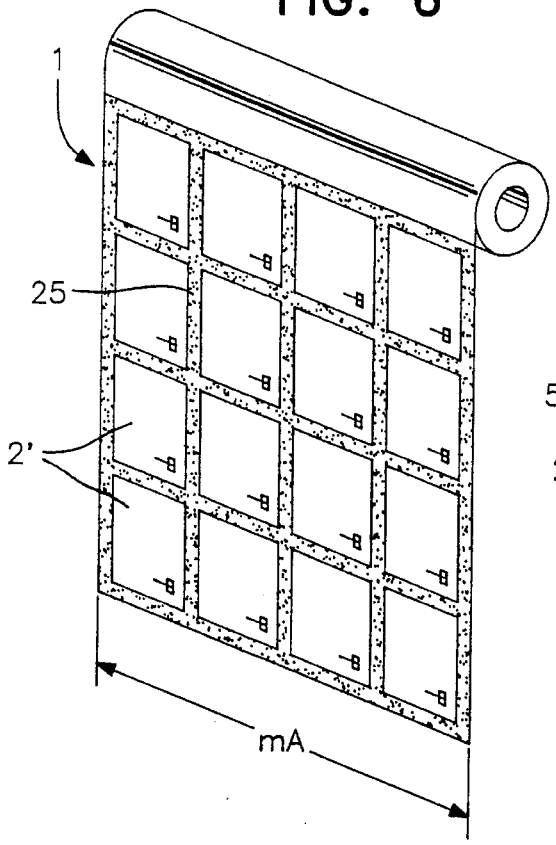
Figure 7:
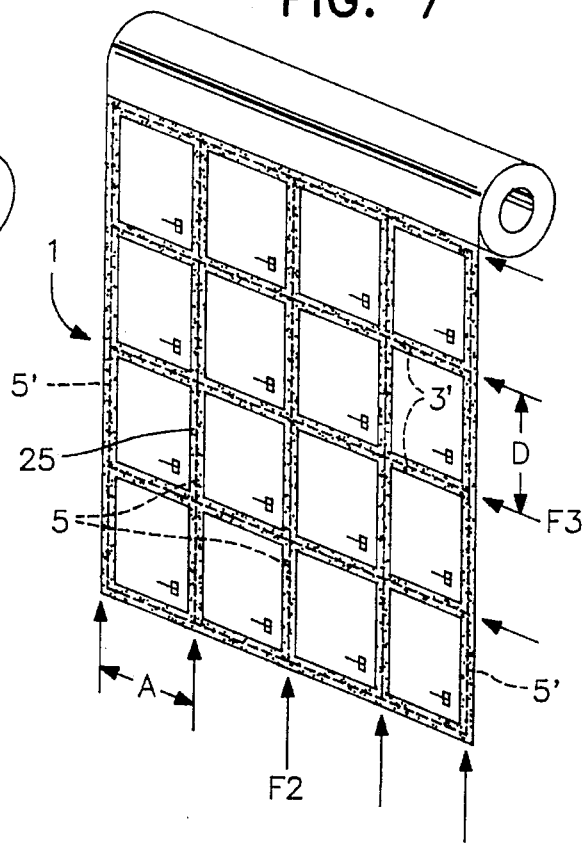
Figure 8:
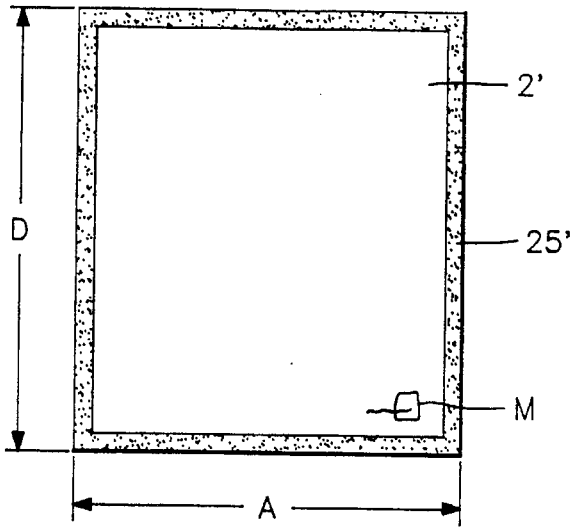
Figure 9:
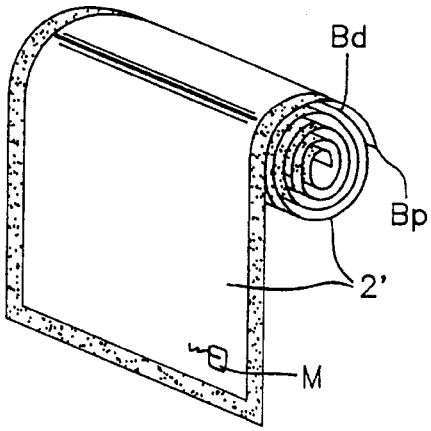
Figure 10:
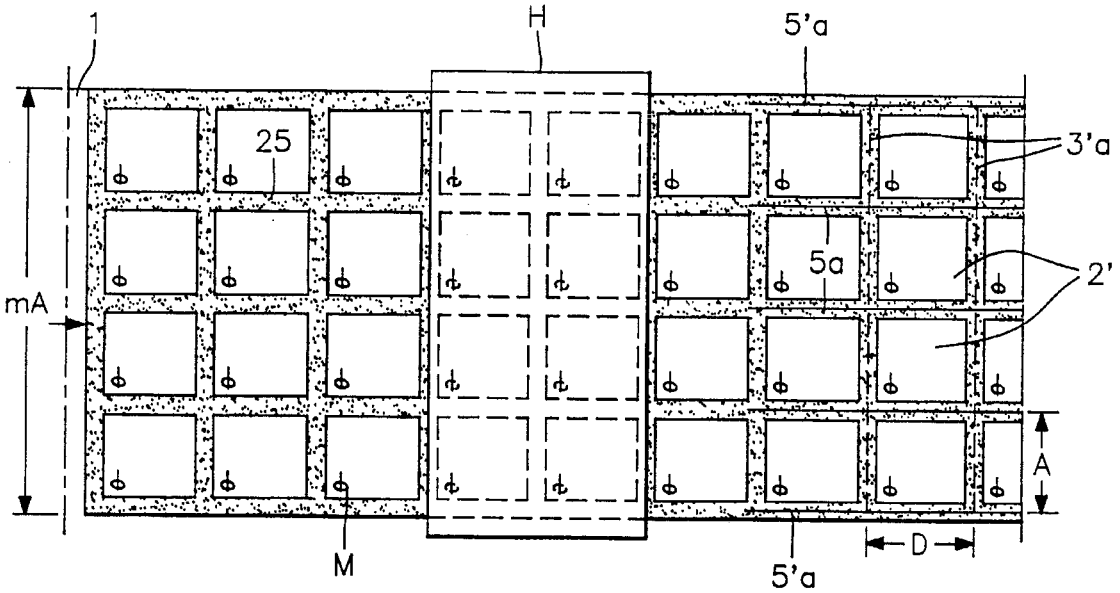
Figure 11:
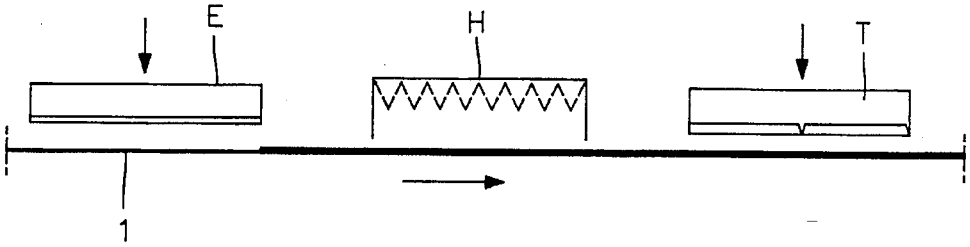
Figure 12:
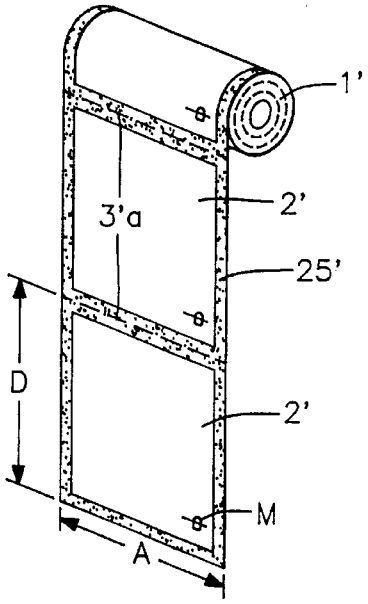

FIG. 2*a* is a perspective view of the piece of rolled fabric in the operation of making the longitudinal cuts;

FIG. 2*b* is a perspective view of the piece of rolled fabric provided with the longitudinal cuts, in the operation of making the transversal cuts;

FIG. 3*a* is a perspective view of the piece of rolled fabric arranged on a support;

FIG. 3*b* is a perspective view of the piece of rolled fabric of the individualized disposable cleaning cloths arranged in overlapping zig-zag form and set in a container;

FIG. 4 is a schematic side elevation view of an installation for carrying out the operations of the process of the invention;

FIG. 5 is a side elevation view of an alternative installation for carrying out the operations of the process;

FIG. 6 is a perspective view of the piece of fabric in the printing stage;

FIG. 7 is a perspective view of the piece of fabric already printed, indicating the longitudinal and transversal cutting lines;

FIG. 8 shows the resulting cleaning cloth;

FIG. 9 is a perspective view of the cleaning cloths arranged rolled and overlapping for dispensing thereof;

FIG. 10 is a schematic plan view of the fabric printing and cutting process;

FIG. 11 shows that process in schematic elevation view;

FIG. 12 is a perspective view of a roll of cleaning cloths obtained for subsequent separation thereof.

In accordance with the drawings, the process of the invention for producing disposable cleaning cloths starts from a piece of knit or woven fabric 1, made from natural or synthetic fibres or mixtures of both types, which on emergence from the loom is subjected to conventional continuous or batch finishing processes, which processes broadly include continuous finishing, preparation, dyeing, finish, print, caustification, mercerizing and other finishing operations, and in respect of batch finishing, corresponding to woven or knitted cotton, fibre or mixed fabrics.

Figure 1:
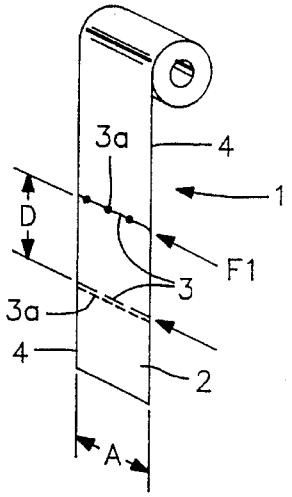
FIG. 1 is a perspective view of the piece of rolled fabric, with width corresponding to the cleaning cloth to be obtained.

In the process of the invention, the fabric piece 1 may present width A corresponding to that of the disposable cleaning cloth 2 to be obtained, as illustrated in FIG. 1, which piece is subjected to successive intermittent transversal cuts 3 in the direction of the weft and spaced apart at a distance D depending on the length of the cleaning cloth, with arrows F1 indicating the operation to implement said transversal cuts 3.

Said transversal cuts are made in such a way that they prevent unravelling and help the user detach each disposable cleaning cloth 2 from the rest of the piece of fabric 1. The longitudinal edges 4 of the disposable cleaning cloth 2 in the direction of the warp of the fabric piece 1, illustrated in FIG. 1, may not be unravelled either.

FIG. 2 shows a fabric piece 1 whose width mA is a multiple of the width A envisaged for the disposable cleaning cloths 2 obtained with the process of the invention. On that fabric piece 1, as shown in FIG. 2*a*, the longitudinal cuts 5 in the direction of the warp are made first, spaced apart depending on the width A of the disposable cleaning cloths 2, said operation being indicated by the arrows F2. As shown in FIG. 2*b*, the fabric piece 1 is then subjected to the operation of intermittent transversal cuts 3 in the direction of the weft, which operation is indicated with the arrows F3.

The process of the present invention provides that, in making said cuts 3 (FIG. 1) and 5 and 3 (FIGS. 2*a* and 2*b*) during the cutting operation itself, the cut threads are simultaneously bonded together in order to avoid unravelling of the edges of the disposable cleaning cloth 2 obtained.

In the invention, said cuts 3 (FIG. 1) and 5 and 3 (FIGS. 2*a* and 2*b*), can be implemented in two independent operations, successive or otherwise and in any order, one operation of cutting and the other of bonding together of the cut threads in order to avoid unravelling of the edges of the disposable cleaning cloth 2 obtained, or they may be implemented in a single operation.

The disposable cleaning cloth 2 obtained by said process consists in a rectangular portion (see FIGS. 1 and 2*b*) of fabric, preferably square, whose four edges may not be unravelled.

FIGS. 3*a* and 3*b* show two different ways of supplying the disposable cleaning cloths 2, while FIG. 3*a* shows an entire fabric piece 1 provided with the transversal cuts 3, arranged in rolled form and held on a support 6 (illustrated by dash line), from which the cleaning cloths 2 are individualized by means of the transversal cuts 3. FIG. 3*b* shows the individualized disposable cleaning cloths arranged in overlapping zig-zag form inside in a container 7 provided with a dispenser opening, through which the disposable cleaning cloth 2 can be removed individually.

FIGS. 4 and 5 show schematically respective installations for carrying out the process of the present invention, in which installations the longitudinal fabric piece 1 is arranged in bobbin 9 form on a support 10. Piece 1 is fed to an unroller drive assembly 11, from which it passes to a compensating device 12 and a drive assembly 13, and from there to longitudinal sizing units 14, after which it passes to longitudinal dryers 15, and then to longitudinal cutters 16.

In the installation illustrated in FIG. 4, after the longitudinal cutters 16 the fabric piece 1 passes on to a transversal sizing unit 17, and then to a drying chamber 18 of the transversal sizer, from which the piece 1 passes to a rotary transversal cutting unit 19, and from there to a contact take-up unit 20, the fabric piece 1 emerging as illustrated in FIG. 2*b*.

In respect of the installation illustrated in FIG. 5, after the longitudinal cutters 16 the fabric piece 1 passes on to a series of transversal cutter units 21 of suitable number, from which the piece 1 passes to a drive unit 22 and from that to compensating roller 23, passing finally to a contact take-up unit 24 similar to unit 20 of FIG. 4, thus providing the fabric piece 1 as illustrated in FIG. 2*b*.

In the installations illustrated in FIGS. 4 and 5 the sizing units-dryers and the cutters can of course be positioned in the inverse order to that illustrated and, as provided in the invention, could be arranged in simultaneous fashion.

In FIG. 2*b*, the fabric piece 1 can be separated into several pieces in accordance with FIG. 1.

Where the fabric is made of synthetic fibres or a mixture containing synthetic fibres, the bonding of threads in the cutting operation can be implemented by weld bonding, for example using hot blades.

In the invention, the transversal cuts 3 can present any linear, undulated, zig-zag or other configuration, of which several examples are illustrated, which transversal cuts present points of incision 3*a* to permit individual detachment of the disposable cleaning cloth 2 from the rest of the fabric piece 1. Said points of incision can be arranged in the cut 3 to a number, spacing and length suitable to facilitate individual detachment of the fabric piece.

In FIGS. 6 to 9, the cleaning cloth is obtained from a fabric piece 1 of a width mA which is approximately a multiple of the width A envisaged for the cleaning cloths 2', which fabric piece is subjected to ambient temperature printing by a flat or rotary machine, in which operation grid sections 25 are obtained in a particular colour and the threads in said linear zones are bonded.

Longitudinal cuts 5 are then made in accordance with the operation indicated with the arrows F2, depending on the width A of the cleaning cloths, and the piece is then subjected to transversal cuts 3' in the operation indicated with the arrows F3, depending on the length D desired for the cleaning cloth. Both longitudinal and transversal cuts are made by following the middle line of the lineal gridded printing zones 25.

The longitudinal cuts 5' corresponding to the longitudinal edges of the fabric piece 1 are not essential, but they are to be recommended to provide the cleaning cloth with a perfect border on all four sides, these fabric edge cuts eliminating selvedge, which is not always perfect.

Even though the transversal cuts 3' can be intermittent, as mentioned hereinbefore, it is envisaged that the cuts will in this case be continuous, thus resulting in a totally independent cleaning cloth 2' which can be commercialized loose and individually or in packages of several units.

As a preferred presentation, however, it is envisaged that these cleaning cloths be commercialized in rolled packages (FIG. 9) arranged one on top of the other in overlapping form, that is, with the rear-edge zone Bp of one free cleaning cloth over the front-edge zone Bd of the following cleaning cloth. This arrangement of rolled cleaning cloths on a tubular spindle thus permits the next cleaning cloth to be dragged by the traction of the front cleaning cloth, leaving it in frontal position for pulling off in the next cleaning cloth-dispensing operation. This rolled presentation is obtainable by means of a machine which i addition to making the transversal cuts also performs this rolling of the resulting cleaning cloths.

In the printing operation, in addition to the grid 25 which leaves a peripheral coloured band 25' on the cleaning cloth, printing of a manufacturer trademark M or any other appropriate ornamental design or publicity motif can be obtained.

The piece of fabric 1 after the printing operation E (FIG. 10) at ambient temperature using a flat machine, in which operation the grid 25 of a particular colour is obtained and with it the bonding of the threads in said intercrossing linear zones, then passes through a stove H for drying of the printed piece, following which it is subjected to a cutting operation in which longitudinal cuts 5*a* and 5'*a* along the width A of the cleaning cloths and intermittent transversal cuts 3'*a* down the desired length D of the cleaning cloth are obtained. Both longitudinal and transversal cuts follow approximately the middle line of the linear zones of the gridded printed fabric 25, and are made using a die T.

These operations provide a long piece of fabric 1' made up of successive cleaning cloths 2' which present a coloured peripheral band 25' and are joined together by points following the intermittent transversal cuts 3'*a*, which fabric piece is supplied in rolled form (FIG. 12), from which the cleaning cloths can be detached by breaking the weakened line of union resulting from the cut 3'*a*.

It will be understood that if the transversal cuts 3'*a* are continuous then the process will result in production of individual cleaning cloths, to be dispensed in presentations suitable for commercialization.

It is also envisaged that in the cleaning cloth manufacturing process the cutting operation T and the thread bonding E operation in the cutting zones be carried out in a single operation, and that the printing operation can be carried out after the cutting operation instead of before it.

This operation can also be carried out with a rotary machine instead of the flat one, as illustrated, with the appropriate printing and cutting cylinders, while the printing operation can be replaced by another adhesive bonding operation or the like to join the fabric threads at the cut zones.

I claim:

1. A process for obtaining disposable cleaning cloths, starting from woven or knit fabric made of natural or synthetic fibers or mixtures of the two, which upon output from a loom is subjected to conventional continuous or batch finishing processes, wherein said process comprises the steps of:

providing a fabric piece of said fabric having a width corresponding to that of the cleaning cloth to be obtained, making successive transversal cuts intermittently or continuously in the direction of the weft, spaced according to the length of the cleaning cloth, which cuts prevent subsequent unravelling and help the user to detach each cleaning cloth individually from the rest of the piece with the longitudinal edges of the cleaning cloth which may not be unraveled either, extending in the direction of the warp, wherein, when said fabric has a width which is a multiple of said width of the cleaning cloth to be obtained, said step of providing a fabric piece includes the step of making longitudinal cuts continuously in the fabric in the direction of the wrap, said longitudinal cuts being spaced according to said width of the cleaning cloth, and printing a peripheral trim of the cleaning cloth along said transversal and longitudinal cuts in the fabric at ambient temperature for bonding of the cuts threads of the fabric to avid unravelling of the edges of the cleaning cloth.

2. The process of claim 1, wherein said cuts are implemented in two operations, one of cutting and the other of bonding of the cut threads in order to avoid unravelling of the edges of the disposable cleaning cloth obtained.

3. The process of claim 1, wherein said transversal cuts are continuous and wherein the cleaning cloths resulting from the transversal cuts are rolled one on top of the other with a transversal rear-edge zone of one cleaning cloth overlapping the transversal front-edge zone of the following cleaning cloth, the thereby facilitate commercialization thereof.

4. The process of claim 1, wherein said step of making successive transversal cuts is carried out in such a way that a rectangular cleaning cloth is obtained, with stamped and ravel-free edges.

5. The process of claim 1, wherein the continuous longitudinal cuts in the direction of the warp, and the transversal cuts in the direction of the weft, are made in a single cutting operation.

6. The process of claim 5, wherein the printing of the threads to bond the cut threads is effected in an independent operation from said step of making successive transversal cuts intermittently or continuously in the direction of the weft.

7. A disposable cleaning cloth, obtained by the process of claim 1 when said successive transversal cuts are made continuously, which comprises a rectangular portion of fabric which has ravel-free edges.

8. A process for obtaining disposable cleaning cloths, starting from woven or knit fabric made of natural or synthetic fibers or mixtures of the two, which upon output from a loom is subjected to conventional continuous or batch finishing processes, wherein said process comprises the steps of:

providing a fabric piece of said fabric having a width corresponding to that of the cleaning cloth to be obtained, making successive transversal cuts continuously in the direction of the weft, spaced according to the length of the cleaning cloth, which cuts prevent subsequent unravelling and help the user to detach each cleaning cloth individually from the rest of the piece with the longitudinal edges of the cleaning cloth which may not be unravelled either, extending in the direction of the warp, wherein, when said fabric has a width which is a multiple of said width of the cleaning cloth to be obtained, said step of providing a fabric piece includes the step of making longitudinal cuts continuously in the fabric in the direction of the warp, said longitudinal cuts being spaced according to said width of the cleaning cloth, said transversal and longitudinal cuts being made in the fabric in such a way that cut threads of the fabric are bonded together in order to avoid unravelling of the edges of the cleaning cloth, bonding of the threads is implemented by printing the transversal and longitudinal cuts, and rolling the cleaning cloths resulting from the cuts one on top of the other with a transversal rear-edge zone of one cleaning cloth overlapping the transversal front-edge zone of the following cleaning cloth, to thereby facilitate commercialization thereof.

9. A process for obtaining disposable cleaning cloths, starting from woven or knit fabric made of natural or synthetic fibers or mixtures of the two, which upon output from a loom is subjected to conventional continuous or batch finishing processes, wherein said process comprises the steps of:

providing a fabric piece of said fabric having a width corresponding to that of the cleaning cloth to be obtained, making successive transversal cuts intermittently or continuously in the direction of the weft, spaced according to the length of the cleaning cloth, which cuts prevent subsequent unravelling and help the user to detach each cleaning cloth individually from the rest of the piece with the longitudinal edges of the cleaning cloth which may not be unravelled either, extending in the direction of the warp, wherein, when said fabric has a width which is a multiple of said width of the cleaning cloth to be obtained, said step of providing a fabric piece includes the step of making longitudinal cuts continuously in the fabric in the direction of the warp, said longitudinal cuts being spaced according to said width of the cleaning cloth, said transversal and longitudinal cuts being made in the fabric in such a way that cut threads of the fabric are bonded together in order to avoid unravelling of the edges of the cleaning cloth, bonding of the threads is implemented by printing the transversal and longitudinal cuts, and wherein the continuous longitudinal cuts in the direction of the warp, and the transversal cuts in the direction of the weft, are made in a single cutting operation.

* * * * *